US009232833B2

(12) United States Patent
Paik et al.

(10) Patent No.: US 9,232,833 B2
(45) Date of Patent: Jan. 12, 2016

(54) DOUBLE LOCKING BUCKLE

(71) Applicants: Jisook Paik, Seoul (KR); Nan Hee Paik, Seoul (KR); Ji Hye Paik, Seoul (KR); Ji Won Son, Seoul (KR)

(72) Inventors: Jisook Paik, Seoul (KR); Nan Hee Paik, Seoul (KR); Ji Hye Paik, Seoul (KR); Ji Won Son, Seoul (KR)

( * ) Notice: Subject to any disclaimer, the term of this patent is extended or adjusted under 35 U.S.C. 154(b) by 37 days.

(21) Appl. No.: 13/900,371

(22) Filed: May 22, 2013

(65) Prior Publication Data

US 2013/0312233 A1 Nov. 28, 2013

(30) Foreign Application Priority Data

May 24, 2012 (KR) ..... 10-2012-0055228

(51) Int. Cl.
*A44B 11/26* (2006.01)

(52) U.S. Cl.
CPC ..... *A44B 11/266* (2013.01); *A44B 11/263* (2013.01); *Y10T 24/45251* (2015.01); *Y10T 24/45529* (2015.01); *Y10T 24/45581* (2015.01)

(58) Field of Classification Search
CPC . A44B 11/263; A44B 11/266; A44B 11/2592
USPC ..... 24/614, 615, 594.1, 625, 618, 163 R
See application file for complete search history.

(56) References Cited

U.S. PATENT DOCUMENTS

| | | | | |
|---|---|---|---|---|
| 4,825,515 | A * | 5/1989 | Wolterstorff, Jr. | 24/625 |
| 5,584,105 | A * | 12/1996 | Krauss | 24/614 |
| 6,684,466 | B2 * | 2/2004 | Nishida et al. | 24/615 |
| 8,484,814 | B2 * | 7/2013 | Parisi | 24/614 |
| 2011/0271499 | A1 * | 11/2011 | Parisi | 24/615 |

* cited by examiner

*Primary Examiner* — Robert J Sandy
*Assistant Examiner* — Michael Lee
(74) *Attorney, Agent, or Firm* — Novick, Kim & Lee, PLLC; Jae Youn Kim

(57) ABSTRACT

Disclosed is a double locking buckle. The double locking buckle includes a plug member having a pair of lock arms and a locking rod provided between the lock arms and a socket member having locking parts in a chamber with which the lock arms are locked. A locking unit is provided at the front end of the locking rod, and the socket member is provided at the center thereof with a guide groove coupled with the locking road and a locking protrusion coupled with the locking unit.

6 Claims, 7 Drawing Sheets

DOUBLE LOCKING BUCKLE

BACKGROUND OF THE INVENTION

1. Field of the Invention

The present invention relates to a buckle. In more particular, the present invention relates to a double locking buckle including a plug member and a socket member, which are mounted on free end portions of a belt or a strap attached to various articles such as clothes, bags, and helmets and detachably coupled with each other such that they are not unintentionally separated from each other due to the impact or the collision.

2. Description of the Related Art

In general, a buckle serves as a fastening member in which two members are fixedly coupled with each other and easily detachable from each other. The fastening member is manufactured by integrally molding a plastic material to enable the elastic coupling.

FIG. 1 is a schematic perspective view showing one example of a typical buckle according to the related art. The buckle includes a plug member 10 and a socket member 20.

Although not shown in FIG. 1, the plug member 10 has a pair of lock arms 12 that linearly protrude from a base 11 of a body and have elasticity. Coupling parts protrude outward of front ends of the lock arms 12, respectively. Locking rods 13 linearly extend longitudinally from the base 11 between the lock arms 12. The socket member 20 has an open chamber 21 extending from a front end thereof to receive the plug member 10, and has a pair of holes 22 facing each other at both sidewalls thereof, so that the lock arms 12 are elastically coupled with the holes 22.

If a user inserts the plug member 10 into the socket member 10 from the entrance of the front end of the socket member 10 through the chamber 21, outer surfaces of the paired lock arms 12 formed at both sides of the plug member slide along inner sidewalls of the socket member 20 while being elastically bent to the inside of the socket member 20. When end portions of the lock arms 12 are positioned in the paired holes 22, the lock arms 12 elastically return to the outside while being seated, so that the plug member 10 is coupled with the socket member 10.

However, if the buckle in the assembled state receives a strong impact from the outside, the lock arms are inwardly bent, so that the lock arms may be unintentionally separated from each other. If the buckle is applied to an assembly requiring a secrete or security, for example, a belt used to receive weapons such as guns, or bags or other attachments used in a dangerous situation, the buckle is unintentionally released as described above, thereby causing a very emergency situation or an accident.

In order to solve the above problem, a buckle having a security function has been suggested as shown in FIG. 2. Regarding the buckle having the security function, the buckle includes the plug member 10 and the socket member 20. The lock arms 12 of the plug member 10 are inserted into the chamber 21 of the socket member 20, and elastically coupled with the holes 22 formed in both lateral sides of the socket member 20, so that the plug member 10 is assembled with the socket member 20.

In addition, the plug member 10 is additionally provided at the intermediate portion thereof with a locking member 30 which is elastically biased upward to elastically operate up and down, and a pressing button 31 operating integrally with the locking member 30 is provided adjacent to the locking member 30. A locking hole 25 communicating with a chamber is formed at one end of the socket member 20 in a position corresponding to the locking member 30 when the plug member 10 is completely coupled with the socket member 20.

Accordingly, when the plug member 10 is inserted into the socket member 20 and coupled with the socket member 20, the lock arms 12 and the locking member 30 of the plug member 10 are fixedly coupled with the socket member 20 doubly. In order to separate the plug member 10 from the socket member 20, the coupling state between the lock arms 12 and the holes 22 must be released by pressing the lock arms 12 of the plug member 10 from both outsides, and the coupling state between the locking member 30 and the locking hole 25 must be released by pressing the pressing button 31, so that the plug member 10 can be separated from the socket member 20.

However, although the buckle shown in FIG. 2 is doubly locked to prevent the buckle from being released due to the external strong tensile force when comparing with the buckle of FIG. 1, a user must use two hands thereof in order to release the double locking of the buckle shown in FIG. 2.

In addition, since the socket member shown in FIGS. 1 and 2 has a shape of a box with a chamber therein, the box of the socket member may be broken due to the external impact. In particular, the socket member shown in FIGS. 1 and 2 is unsuitable for security.

SUMMARY OF THE INVENTION

An object of the present invention is to provide a double locking buckle, capable of preventing a socket and a plug member, which are coupled with each other, from being unintentionally separated from each other due to external strong impact.

Another object of the present invention is to provide a double locking buckle, capable of securely maintaining the coupling state thereof, and capable of allowing a user to simply release a doubling locking state with one hand when separating a plug member from a socket member.

Still another object of the present invention is to provide a double locking buckle in which a socket constituting the double locking buckle can sufficiently endure against external impact through a structure having two separated chambers to represent stiffness stronger than that of a conventional socket having one box-type chamber.

In order to accomplish the above objects, there is provided a double locking buckle including a plug member and a socket member. The plug member includes a base part, a pair of lock arms protruding from the base part such that the plug member is coupled with the socket member, and a locking rod protruding from the base part in an intermediate part between the lock arms. The socket member includes a chamber, which has upper and lower plates, sidewalls connecting the upper plate with the lower plate, and an open front end to receive the lock arms, and holes communicating through the chamber such that front ends of the lock arms are coupled with the holes. The socket member is provided at an intermediate part thereof with a guide groove longitudinally formed to guide the locking rod. The guide groove has a shape to divide the chamber into both sides such that independent chambers are formed at left and right sides of the guide groove.

In addition, the guide groove is open at a front surface and an upper portion thereof when viewed in a forwarding direction of the plug member.

Further, the guide groove is provided on an entrance bottom surface thereof with an inclined guide surface to allow the locking rod to enter, the guide groove is provided on a bottom surface thereof with a locking protrusion for coupling with the plug member, and the locking protrusion has an inclined surface formed at an entrance side of the locking rod, and a right-angled surface formed in opposition to the entrance side of the locking rod.

Further, the locking rod has an upper portion formed integrally with a wing part longitudinally extending beyond an end portion of the locking rod and having a wide width, and the wing part is provided at a front lower end thereof with a protrusion.

In addition, seating parts are formed in both upper ends of the guide groove provided in the socket member such that the wing part is tightly guided.

In addition, the locking rod is provided in a bottom surface thereof with a groove serving as a locking unit, and the groove has a shape of a rectangle box having an open lower portion such that the locking protrusion is introduced into the groove.

Further, the locking rod extends forward of the base part at a position higher than a widthwise height of the base part.

As described above, according to the present invention, the buckle is assembled in the double locking state, so that the buckle is not unintentionally released due to the external strong impact.

According to the present invention, when separating the plug member from the socket member, a user can simply release a doubling locking state with one hand.

According to the present invention, the socket member constituting the double locking buckle has two chambers to represent stiffness stronger than that of a conventional socket member having one box-type chamber, so that the socket member can sufficiently endure against external impact.

DETAILED DESCRIPTION OF THE INVENTION

Hereinafter, one embodiment of the present invention will be described with reference to accompanying drawings in more detail.

Figure 1:
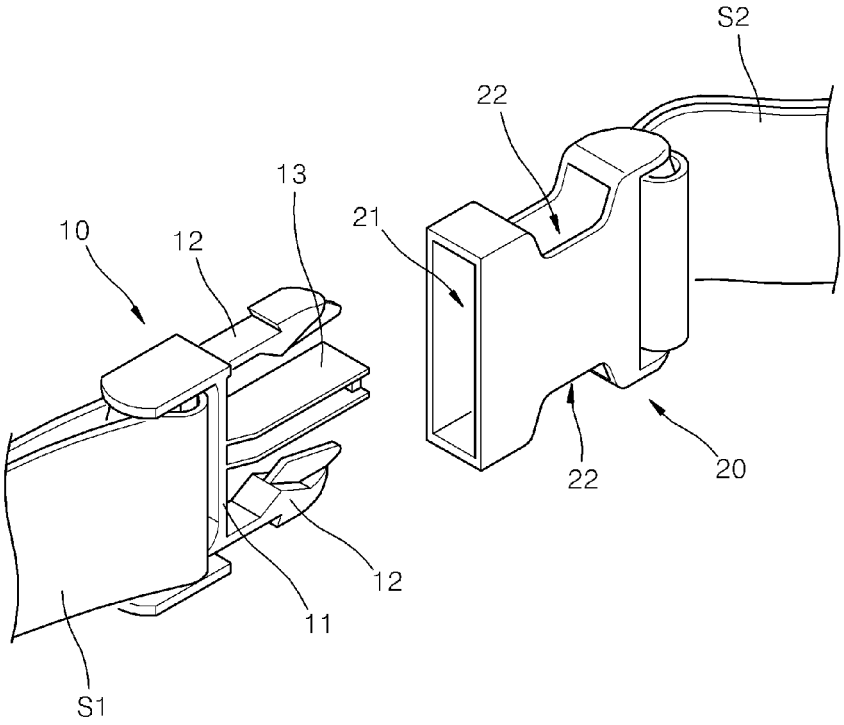
FIG. 1 PRIOR ART
FIG. 1 is a perspective view showing one example of a typical buckle according to the related art.
Figure 2:
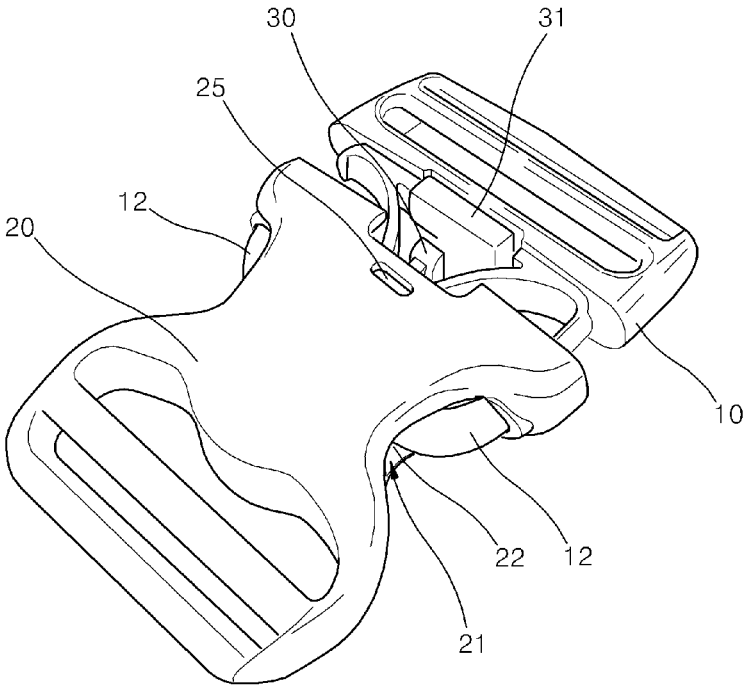
FIG. 2 PRIOR ART
FIG. 2 is a perspective view showing one example of a buckle having a security function according to the related art.
Figure 3:
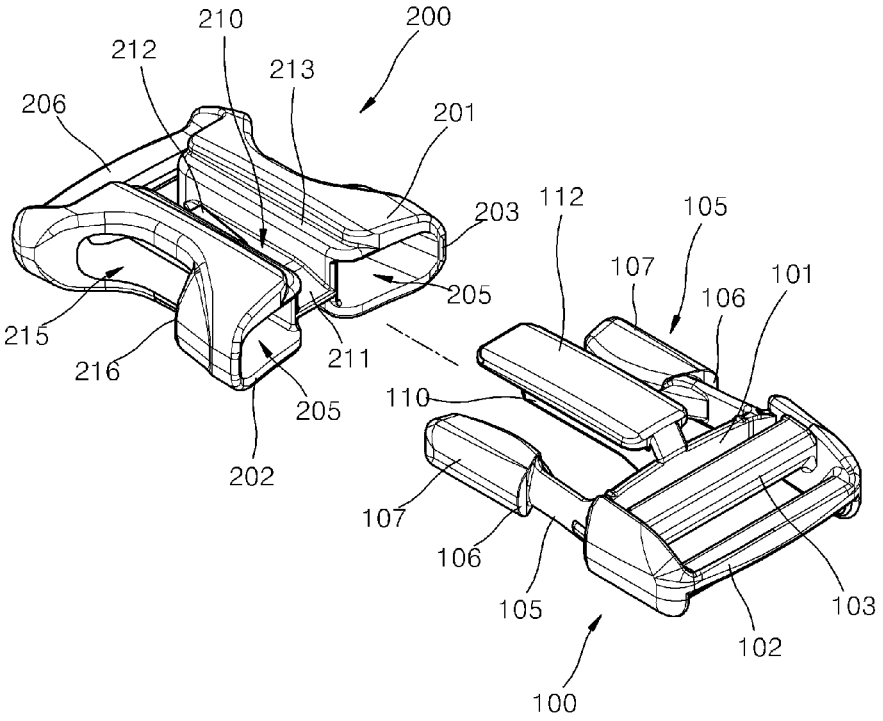
FIG. 3 is an exploded perspective view showing one example of a buckle according to the present invention.
Figure 4:
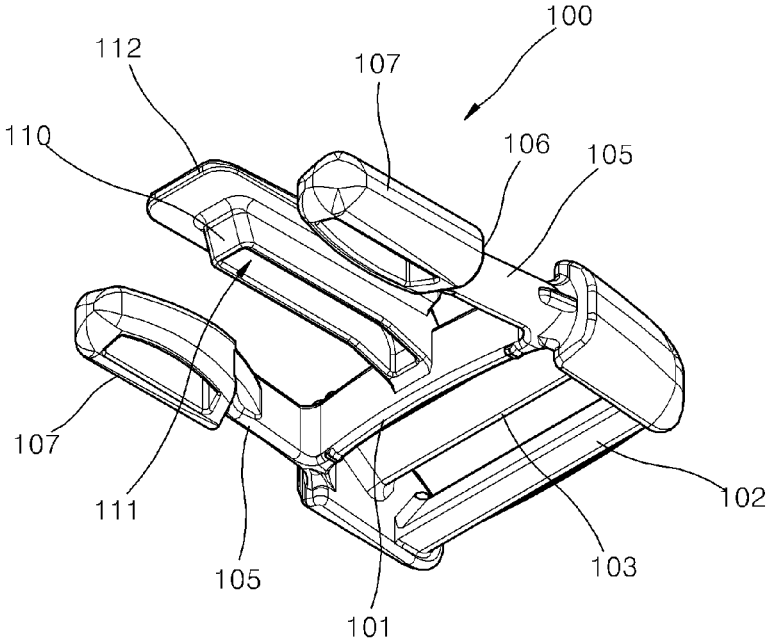
FIG. 4 is a bottom perspective view showing a plug member according to the present invention.
Figure 5:
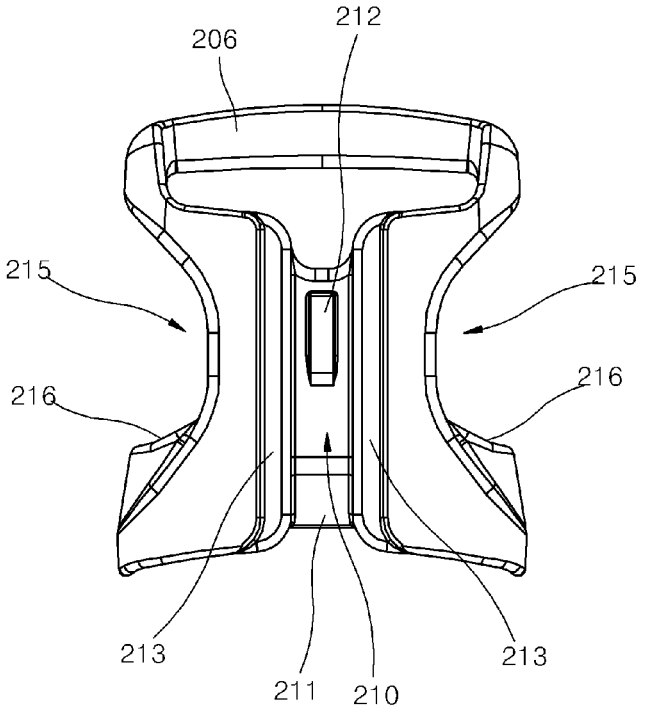
FIG. 5 is a plan view showing a socket member according to the present invention.
Figure 6:
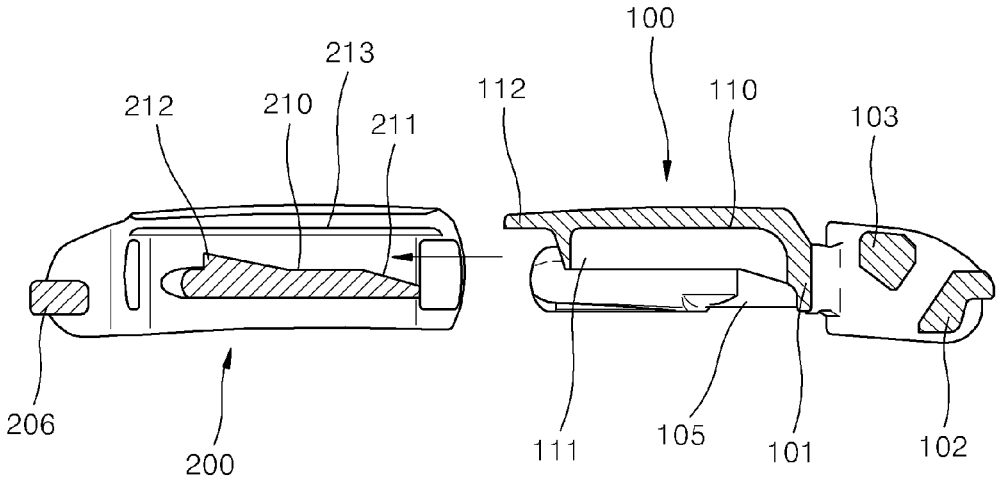
FIG. 6 is a side sectional view showing the socket member and the plug member according to the present invention.

FIG. 3 is an exploded perspective view showing one example of a buckle according to the present invention, and FIG. 4 is a bottom perspective view showing a plug member according to the present invention. FIG. 5 is a plan view showing a socket member according to the present invention, and FIG. 6 is a side sectional view showing the socket member and the plug member according to the present invention.

Referring to FIGS. 3 to 6, the buckle according to the present invention includes a plug member 100 and a socket member 200, which are detachably coupled with each other, and the plug member 100 and the socket member 200 are molded by using synthetic resin.

In the plug member 100, a cross bar 102 and a strap hooking bar 103, around which a free end of a strap S1 is wounded, are formed at a rear portion of a base part 101 while transversely extending. The strap S1 is alternately wounded around the cross bar 102 and the strap hooking bar 103 in opposition directions, so that the length of the strap S1 is adjusted. Alternatively, the plug member 100 includes only the cross bar 102 so that the free end of the strap S1 is wounded around the cross bar 102 and fixed to the cross bar 102 through a sewing process.

One pair of lock arms 105 are provided at a front portion of the base part 101 while extending from both sides of the base part 101 in the same direction.

The paired lock arms 105 are symmetric to each other about the center of the base part 101 of the plug member 100, and extend forwardly from the base part 101 with a thin thickness so that the paired lock arms 105 may be elastically bent with respect to the base part 101. End portions of the lock arms 105 are an expanded shape. The expanded end portions form locking steps 106. Pressing parts 107 are formed on outer surfaces of the lock arms 105 while extending from the expanded end portions, at which the locking steps 106 are formed, to front end portions. Accordingly, each of the paired lock arms 105 is classified into the thin-thickness portion, which has elasticity so that the lock arm 105 is bent toward the center of the plug member 100 when a user presses the pressing part 107 toward the center of the plug member 100 from the outside, and the expanded portion of the front end portion of the lock arm 105. The locking step 106 protrudes outward of the starting position of the expanded portion.

A locking rod 110 is provided between the paired lock arms 105 of the plug member 100 while extending forward of the base part 101. The locking rod 110 is provided in a bottom surface thereof with a groove 111 serving as a locking unit. The groove 111 has the shape of a rectangle having an open lower portion, and receives a locking protrusion of the socket member 200, which will be described later, introduced into the groove 111, so that the locking protrusion fixes the locking rod 110.

The locking rod 110 extends forward of the base part 101 at a position higher than the widthwise height of the base part 101. Since the locking rod 110 has elasticity with respect to the base part 101, that is, a connection part between the locking rod 110 and the base part 10 has elasticity, the locking rod 110 may be slightly bent with respect to the base part 101.

A wing part 112 is formed on a top surface of the locking rod 110 while representing a shape expanded more than that of the locking rod 110. The wing part 112 expands in a forward direction and both lateral side directions of the locking rod 110. According to the designs of the buckle, the wing part 112 may expand only in the forward direction of the locking rod 110. The expanded wing part 112 is provided at a front lower end thereof with a linear protrusion to be locked by a nail of a finger of a user so that the user may lift up the wing part 112 without slipping when the user lifts up the wing part 112 with the finger of the user to release the locking of the plug member 100 from the socket member 200

In the socket member 200, a top plate 201 faces a bottom plate 202, and outer portions of the top and bottom plates 201 and 202 are connected to each other through sidewalls 203, so that a pair of chambers 205 receiving therein the paired lock arms 105 while guiding the lock arms 105 are independently formed at both outer end portions of the socket member 202. A cross bar 206 is provided at a rear portion of the socket member 200 while transversely extending to fix a free end portion of another strap S2. Similarly to the plug member 100, the socket member 200 further includes a strap hooking bar to adjust the strap S2.

The socket member 200 is provided at the intermediate portion thereof with a guide groove 210 lengthwise in such a manner that the locking rod 110 is inserted between the chambers 205 in the forwarding direction of the plug member 100. The guide groove 210 makes both chambers 205. The chambers 205 are independently from each other. The guide groove 210 is open at a front surface and an upper portion thereof when viewed in the forwarding direction of the plug member 100.

The guide groove 210 has a width to tightly guide the locking rod 110 and has the inclined surface 211 at the bottom surface of the entrance so that the locking rod 110 is guided in an upward direction. Lateral sides of the entrance are expanded outwardly so that the locking rod 110 may easily enter.

A locking protrusion 212 protrudes from a bottom surface of the guide groove 210. The locking protrusion 212 has a slowly-inclined surface formed at the side for the entering of the locking rod 110, and a right-angled surface in opposition to the side for the entrance of the locking rod 110. Accordingly, when the locking rod 110 enters the guide groove 210, the locking rod 110 is gradually bent in the upward direction along the slowly-inclined surface. Then, the locking rod 110 passes the right-angled surface while the groove 111 of the locking rod 110 is being locked with the locking protrusion 212, thereby restricting the locking rod 110 from being moved back.

When the plug member 100 is inserted into the chambers 205 of the socket member 200, the lock arms 105 of the plug member 100 are introduced into the chambers 205 at both sides divided through the guide groove 210, respectively, and the locking rod 110 is introduced into the guide groove 210 according to the guidance of the guide groove 210. If the plug member 100 is completely coupled with the chambers 205, the base part 101 of the plug member 100 is positioned at the entrance of the chambers 205. In this case, the locking rod 110 is coupled with the guide groove 210. In this state, the groove 111 of the locking rod 110 is coupled with the locking protrusion 212 of the guide groove 210.

Seating parts 213 are formed at the edges of top surface provided at both side walls of the guide groove 210 so that the wing part 112 of the locking rod 110 can be tightly coupled with the seating parts 213 according to the guidance of the guide groove 210. The seating parts 213 are formed at the edges of the both sidewalls of the guide groove 210 in a shape recessed by the thickness of the wing part 112. However, when the wing parts 112 expand in the forward direction, the seating parts 213 may not be formed.

Accordingly, when the plug member 100 is coupled with the socket member 200, the guide groove 210 is completely covered by the wing part 112, and the upper surface of the wing part 112 is formed in parallel to the upper surface of the socket member 200 so that the sense of unity can be totally provided.

The chamber 205 of the socket member 200 has an entrance width to the extent that the front end portion of the lock arm 105 of the plug member 100 can pass through the entrance without the bending of the front end portion of the lock arm 105. Both sidewalls of the chamber 205 are gradually narrowed inward of the entrance. Accordingly, when the plug member 100 is coupled with the chambers 205, the lock arms 105 are pressed inwardly by the gradually-narrowed sidewalls of the chambers 205 while being inserted into the chamber 205, so that the lock arms 105 have sufficient elasticity.

The socket member 200 is provided in both sidewalls thereof with holes 215 to communicate with the chambers 205. The holes 215 allow the front end portions of the lock arms 105, that is, the pressing parts 107 to be exposed. When the lock arms 105 pass through the chamber 205, the lock arms 105 are inwardly pressed and then elastically protrude outwardly at the positions of the holes 215, so that the lock arms 105 are seated in the holes 215. One edge of the hole 215 serves as a locking part 216, and the locking step 106 of the lock arm 105 is locked with the locking part 216, so that the coupling state between the plug member 100 and the socket member 200 can be maintained.

The holes 215 are formed by recessing portions of the upper and lower plates 201 and 202 in the direction of the guide groove 210, so that a space allowing the pressing of the pressing part 107 of the lock arm 105 can be ensured in separating from the plug member 100.

According to the present invention, the chambers 205 of the socket members 200 are divided by the guide groove 210, and the space in which each lock arm 105 is inwardly pushed is restricted by the inner sidewall of the chamber 205 provided at the side of the guide groove 210 even if a user excessively presses the lock arm 105. Accordingly, the lock arms 105 can be prevented from being broken.

Hereinafter, the operation of the buckle having the above structure according to the present invention will be described.

If the lock arm 105 is inserted into the chamber 205 of the socket member 200, since both inner lateral sides of the chamber 205 are gradually narrowed, the lock arm 105 is pressed inward of the chamber 205 while forwarding. If the lock arm 105 reaches the position of the hole 215, the lock arm 105 is elastically biased to the outside, so that the pressing part 107 of the lock arm 105 protrudes out of the hole 215 and is seated in the hole 215.

The seated pressing part 107 of the lock arm 105 is maintained at the stationary state without moving as the locking step 106 of the plug member 100 is engaged with the locking part 216 of the socket member 200.

In addition, simultaneously with the above operation, the locking rod 110 of the plug member 100 enters the guide groove 210 of the socket member 200 according to the guidance of the guide groove 210 of the socket member 200, and the front end portion of the locking rod 110 makes contact with the locking protrusion 212 while being pushed in the upward direction. Then, the front end portion of the locking rod 110 is out of the range of the locking protrusion 212 to return to the original state. Simultaneously, the groove 111 of the locking rod 110 is coupled with the locking protrusion 212, so that a double coupling is formed together with the coupling of the lock arm 105.

Further, in the state that the plug member 100 is coupled with the socket member 200, the locking rod 110 tightly makes contact with the guide groove 210, and the wing part 112 of the locking rod 110 is seated on the seating part 213 provided at the upper end of the guide groove 210 to cover the entire portion of the guide groove 210. Accordingly, the upper surface of the socket member 200 totally forms a plane, so that the sense of unity can be provided.

Since the plug member 100 is coupled with the socket member 200 at three points, even if the undesirable impact or the undesirable pressing is applied to any one of the three points, the plug member 100 is not separated from the socket member 200. Accordingly, the buckle according to the present invention can sufficiently perform security functions in various fields.

In addition, when the plug member 100 is released from the socket member 200, if the pressing part 107 is pressed inward of the hole 215 of the socket member 200 from the outside of the lock arm 105, the locking step 106 of the lock arm 105 is out of the locking part 216 of the socket member 200. Simultaneously, the pressing part 107 of the lock arm 105 makes contact with the inner sidewall of the chamber 205. In this case, the outer surface of the pressed lock arm 105 is actually inclined with respect to the center thereof, and the inner sidewall of the chamber 205 is inclined while being narrowed from the entrance of the chamber 205. Accordingly, the lock arm 105 is separated from the chamber 205 due to the self elasticity of the lock arm 105.

Even though the lock arm 105 is separated from the chamber 205 due to the self elasticity of the lock arm 105, the plug member 100 is not separated from the socket member 200 due to the coupling between the locking protrusion 212 and the groove 111 of the locking rod 110.

In order to completely separate the plug member 100 from the socket member 200, the lock arms 105 must be pressed from both sides, so that the locking steps 106 of the lock arms 105 are separated from the locking parts 216 of the socket member 200, and the front end portion of the locking rod 110 must be lifted up to release the coupling state between the groove 111 of the locking rod 110 and the locking protrusion 212 of the guide groove 210.

Accordingly, when the locking states are simultaneously released at two points of the lock arms 105 and one point of the locking rod 110, that is, three points, the plug member 100 can be separated from the socket member 200. The separation manipulations at the three points can be easily performed in the present invention.

Figure 7:
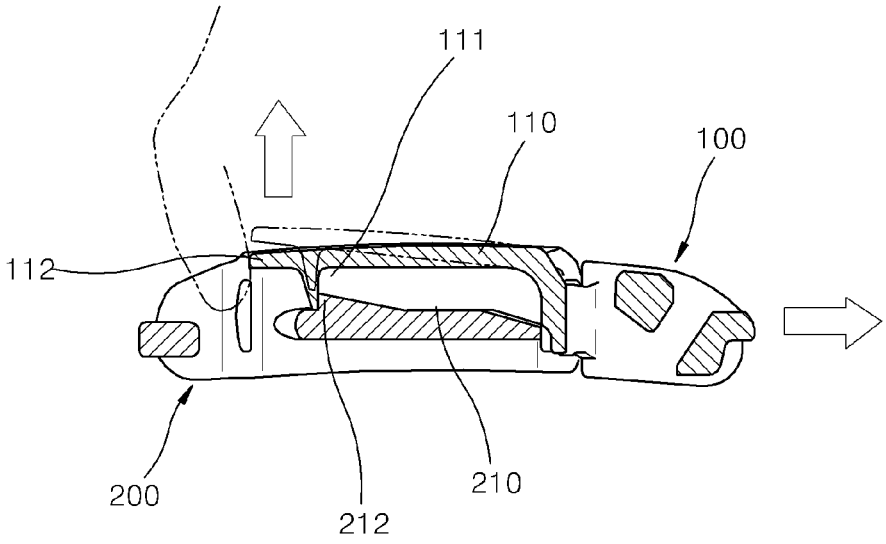
FIG. 7 is a sectional view showing the release state of the buckle according to the present invention.
Figure 8:
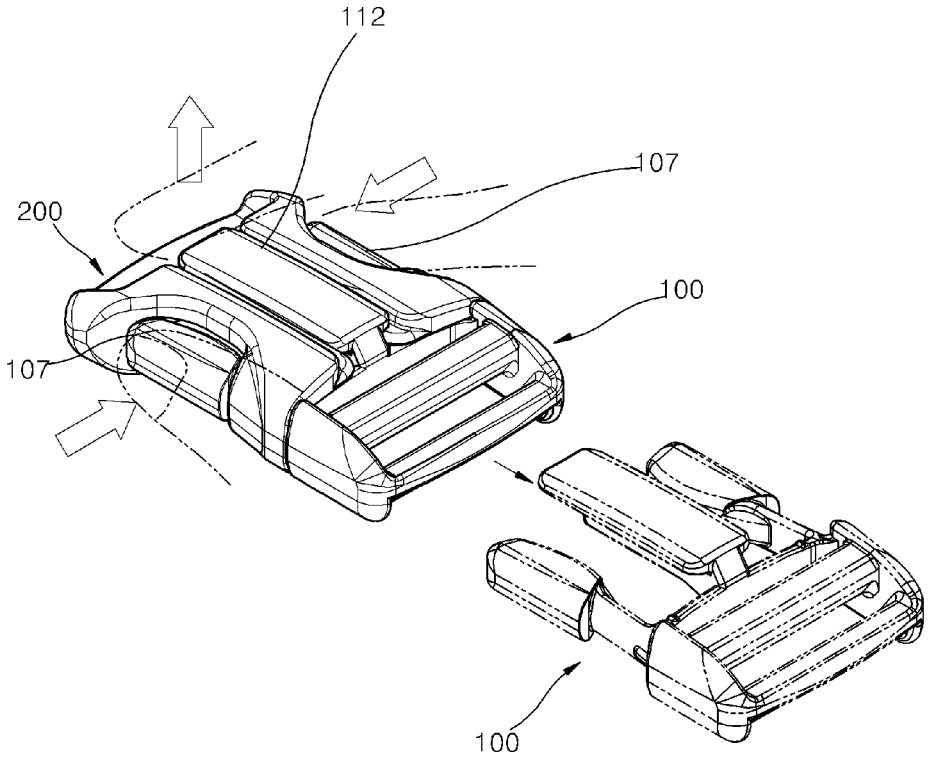
FIG. 8 is a perspective view showing the release state of the buckle according to the present invention.

In other words, if a user presses both lock arms 105 by using a thumb and another finger other than an index finger while lifting up the front end portion of the locking rod 110 as shown in FIGS. 7 and 8 by using the index finger in the state that the plug member 100 is coupled with the socket member 200, the plug member 100 moves backward from the chamber 205 of the socket member 200, so that the plug member 100 is separated from the chamber 205 of the socket member 200 due to the elasticity of the lock arm 105.

Naturally, a user can arbitrarily use one hand or two hands in order to perform the pressing manipulation of the lock arms 105 and the lifting manipulation of the front end of the locking rod 110. However, the present invention has an advantage in that the user can perform all manipulations by using one hand.

For example, the user may hold an object, or may grip something in one hand during various works or in situations such as mount climbing. Under the situations, the user is difficult to release the buckle with two hands.

Therefore, the present invention provides convenience allowing the user to release the buckle with only one hand under the situations.

Although a preferred embodiment of the present invention has been described for illustrative purposes, those skilled in the art will appreciate that various modifications, additions and substitutions are possible, without departing from the subject matter of the present invention. For example, the lengths and the shapes of the locking rod 110 and the guide groove 210 and the coupling state between the locking rod 110 and the guide groove 210 can be modified if necessary. A locking unit formed in the locking rod 110 may include a groove formed along the whole bottom surface of the rectangular locking rod 110 as shown in accompanying drawings, or may partially include a groove shape or a protrusion shape. In other words, the locking unit may have various shapes to be locked with the locking protrusion 212 of the socket member 200, thereby restricting the separation from the locking protrusion 212 of the socket member 200.

What is claimed is:

1. A double locking buckle comprising:

a plug member; and a socket member, wherein the plug member comprises a base part, a pair of lock arms protruding from the base part such that the plug member is coupled with the socket member, and a locking rod protruding from the base part and disposed between the lock arms, the socket member comprises two chambers, each of the two chambers including upper and lower plates and sidewalls connecting the upper plate with the lower plate, an open front end to receive each of the lock arms and a hole located on a side of each of the chambers such that each of front ends of the lock arms is coupled with the hole, the socket member includes a guide groove longitudinally formed to guide the locking rod and disposed in a middle portion of the socket member, the guide groove divides the two chambers into a left chamber and a right chamber formed at left and right sides of the guide groove, respectively, the guide groove includes an upward inclined surface starting from a front end of the guide groove to guide the locking rod having a latching groove into the guide groove, and a locking protrusion located at a rear edge of the upward inclined surface and coupling with the latching groove of the locking rod, and the latching groove of the locking rod is located at a front lower end of the wing part and configured such a way that the latching groove is unlatched with the locking protrusion by pulling up the wing part.

2. The double locking buckle of claim 1, wherein the guide groove is open at a front surface and an upper portion thereof when viewed from an insertion direction of the plug member into the socket member.

3. The double locking buckle of claim 1, wherein the locking rod has an upper portion formed integrally with a wing part longitudinally extending beyond an end portion of the locking rod.

4. The double locking buckle of claim 3, wherein seating parts are formed in both upper ends of the guide groove provided in the socket member such that the wing part is tightly guided.

5. The double locking buckle of claim 1, wherein the latching groove has a shape of a rectangle box having an open lower portion such that the locking protrusion is introduced into the latching groove.

6. The double locking buckle of claim 1, wherein the locking rod extends forward from the base part at a position higher than a widthwise height of the base part.

* * * * *